US006024206A

United States Patent [19]

Leifeld

[11] Patent Number: 6,024,206

[45] Date of Patent: Feb. 15, 2000

[54] CLOSED-CIRCUIT COILER CAN CONVEYOR SYSTEM BETWEEN TWO DRAWING FRAMES

[75] Inventor: Ferdinand Leifeld, Kempen, Germany

[73] Assignee: Trützschler GmbH & Co. KG, Mönchengladbach, Germany

[21] Appl. No.: 08/915,716

[22] Filed: Aug. 21, 1997

[30] Foreign Application Priority Data

Aug. 22, 1996 [DE] Germany ..... 196 33 822

[51] Int. Cl.[7] ..... B65G 25/00

[52] U.S. Cl. ..... 198/465.2; 19/159 A

[58] Field of Search ..... 198/465.2, 580; 19/459 A

[56] References Cited

U.S. PATENT DOCUMENTS

| | | | |
|---|---|---|---|
| 2,331,540 | 10/1943 | Dilling | 198/465.2 |
| 4,462,851 | 7/1984 | Hera . | |
| 4,995,140 | 2/1991 | Geunkinger et al. . | |
| 5,311,645 | 5/1994 | Schwalm et al. . | |
| 5,350,052 | 9/1994 | Gebald et al. | 198/465.2 |

FOREIGN PATENT DOCUMENTS

| | | |
|---|---|---|
| 0 212 979 | 3/1987 | European Pat. Off. . |
| 0 427 681 | 5/1991 | European Pat. Off. . |
| 54 248 | 2/1967 | Germany . |
| 39 05 279 | 8/1990 | Germany . |
| 39 08 833 | 9/1990 | Germany . |
| 41 16 083 | 11/1991 | Germany . |
| 41 28 374 | 7/1992 | Germany . |
| 41 30 463 | 3/1993 | Germany . |
| 43 18 056 | 2/1994 | Germany . |
| 52 999 | 12/1996 | Germany . |
| 941219 | 11/1963 | United Kingdom . |
| 1003808 | 9/1965 | United Kingdom . |
| 2 302 103 | 1/1997 | United Kingdom . |

*Primary Examiner*—James R. Bidwell
*Attorney, Agent, or Firm*—Venable; Gabor J. Kelemen

[57] ABSTRACT

A system includes a first drawing frame having a sliver output; a second drawing frame having a sliver input; and a conveyor apparatus for supplying, in a closed circuit, sliver-filled coiler cans from the output of the first drawing frame to the input of the second drawing frame and for supplying empty coiler cans from the input of the second drawing frame to the output of the first drawing frame. The conveyor apparatus includes first and second storage devices for supporting thereon a plurality of sliver-filled coiler cans and empty coiler cans, respectively. The storage devices are formed of respective conveyor tracks, each having a conveying device. The conveyor apparatus further has transferring devices for moving sliver-filled coiler cans from the output of the first drawing frame to the first conveyor track, from the first conveyor track to the input of the second drawing frame, and for moving empty coiler cans from the input of the second drawing frame to the second conveyor track and from the second conveyor track to the output of the first drawing frame.

10 Claims, 4 Drawing Sheets

FIG. 3a
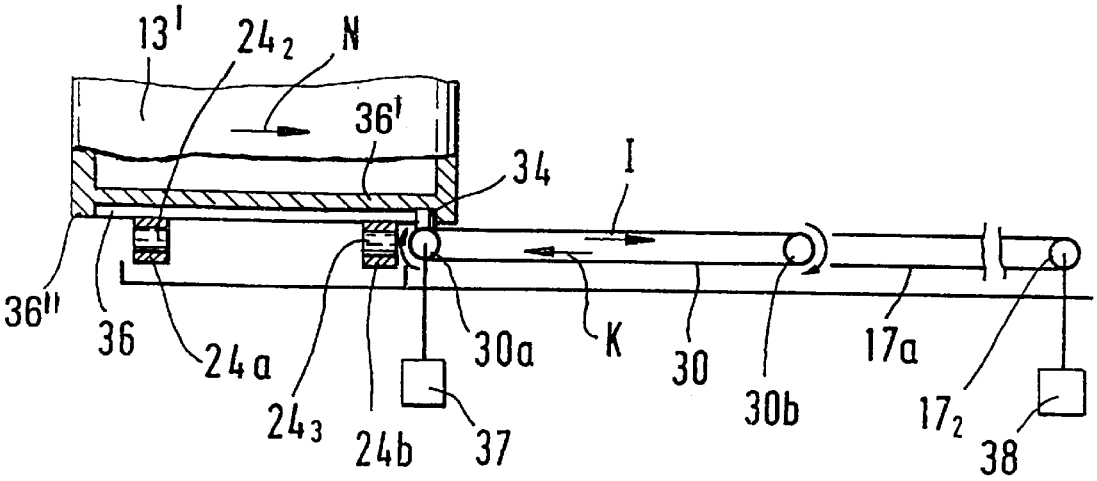
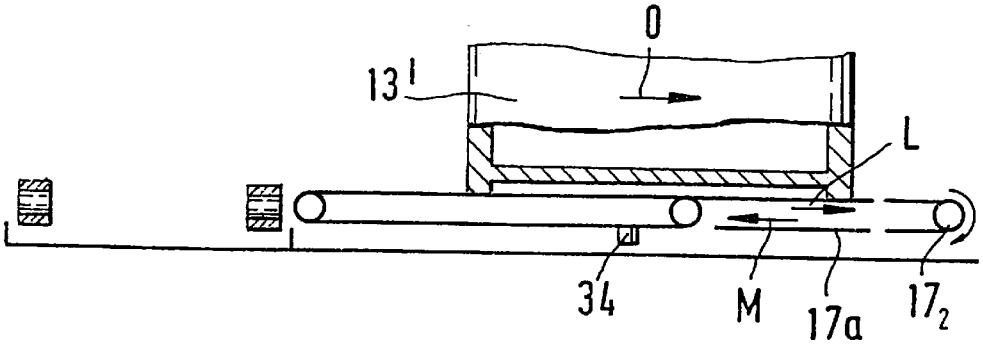
FIG. 3b

CLOSED-CIRCUIT COILER CAN CONVEYOR SYSTEM BETWEEN TWO DRAWING FRAMES

CROSS REFERENCE TO RELATED APPLICATION

This application claims the priority of German Application No. 196 33 822.0 filed Aug. 22, 1996, which is incorporated herein by reference.

BACKGROUND OF THE INVENTION

The invention relates to a coiler can conveyor system between two operationally consecutive drawing frames. The conveyor system is of the type in which the coiler cans are moved in the forward direction by means of at least one conveying device and further wherein the coiler cans which circulate in a closed conveying path may be, at least groupwise, in a direct contact with one another. The closed conveying path forms a polygon whose sides are arranged at an angle to one another.

In a coiler can conveyor system, as disclosed in German Auslegeschrift (application published after examination) No. 1,281,903, the sliver is taken from the full coiler cans by an after-connected drawing frame. For this purpose the full cans are positioned in a U-shaped pattern. The coiler cans, after they are emptied by the downstream-arranged drawing frame, are individually and consecutively admitted to the upstream-arranged drawing frame where the empty coiler cans are filled with sliver. The sliver-filled cans are individually supplied to the downstream-arranged drawing frame. Upstream and downstream of the sliver filling station of the upstream-arranged drawing frame an emplacement is provided for the empty and full coiler cans. It is a disadvantage of this arrangement that the downstream-arranged drawing frame is idle until the required number of sliver-filled cans has been supplied, resulting in a significant delay in the production. It is a further drawback that the supply and removal of the empty and, respectively, full cans are interdependent and, as a consequence, the conventional coiler can conveying system is inflexible.

SUMMARY OF THE INVENTION

It is an object of the invention to provide an improved coiler can conveyor system of the above-outlined type from which the discussed disadvantages are eliminated and which, in particular, makes possible an increased processing speed and is operationally flexible.

This object and others to become apparent as the specification progresses, are accomplished by the invention, according to which, briefly stated, the system includes a first drawing frame having a sliver output; a second drawing frame having a sliver input; and a conveyor apparatus for supplying, in a closed circuit, sliver-filled coiler cans from the output of the first drawing frame to the input of the second drawing frame and for supplying empty coiler cans from the input of the second drawing frame to the output of the first drawing frame. The conveyor apparatus includes first and second storage devices for supporting thereon a plurality of sliver-filled coiler cans and empty coiler cans, respectively. The storage devices are formed of respective conveyor tracks, each having a conveying device. The conveyor apparatus further has transferring devices for moving sliver-filled coiler cans from the output of the first drawing frame to the first conveyor track, from the first conveyor track to the input of the second drawing frame, and for moving empty coiler cans from the input of the second drawing frame to the second conveyor track and from the second conveyor track to the output of the first drawing frame.

By providing a separate coiler can storing device for the empty cans and for the full cans between the upstream and the downstream drawing frames, a plurality of empty cans may be filled with sliver at the upstream-arranged drawing frame while sliver is taken from a plurality of sliver-filled cans at the downstream-arranged drawing frame. Structuring the coiler can storing device as a conveying device permits an operationally flexible supply and removal of the empty and full cans to and from the upstream drawing frame as well as to and from the downstream drawing frame.

The invention has the following additional advantageous features:

The empty coiler can storing device and the full can storing device are arranged in series as viewed in the conveying direction.

The conveying device of the conveying track includes an endless belt or conveying troughs or rollers or the like with suitable drives.

A locking element is associated with the leading can as viewed in the conveying direction.

The storage device for the empty cans and/or the storage device for the full cans include an arrangement which permits an accumulation of coiler cans thereon.

The can accumulator arrangement includes a device which has a can-stopping element at a predetermined location of the conveyor track.

BRIEF DESCRIPTION OF THE DRAWINGS

FIGS. 3*a* and 3*b* are sectional views taken along line III—III of FIG. 2 illustrating a coiler can in two different positions.

DESCRIPTION OF THE PREFERRED EMBODIMENT

Figure 1:
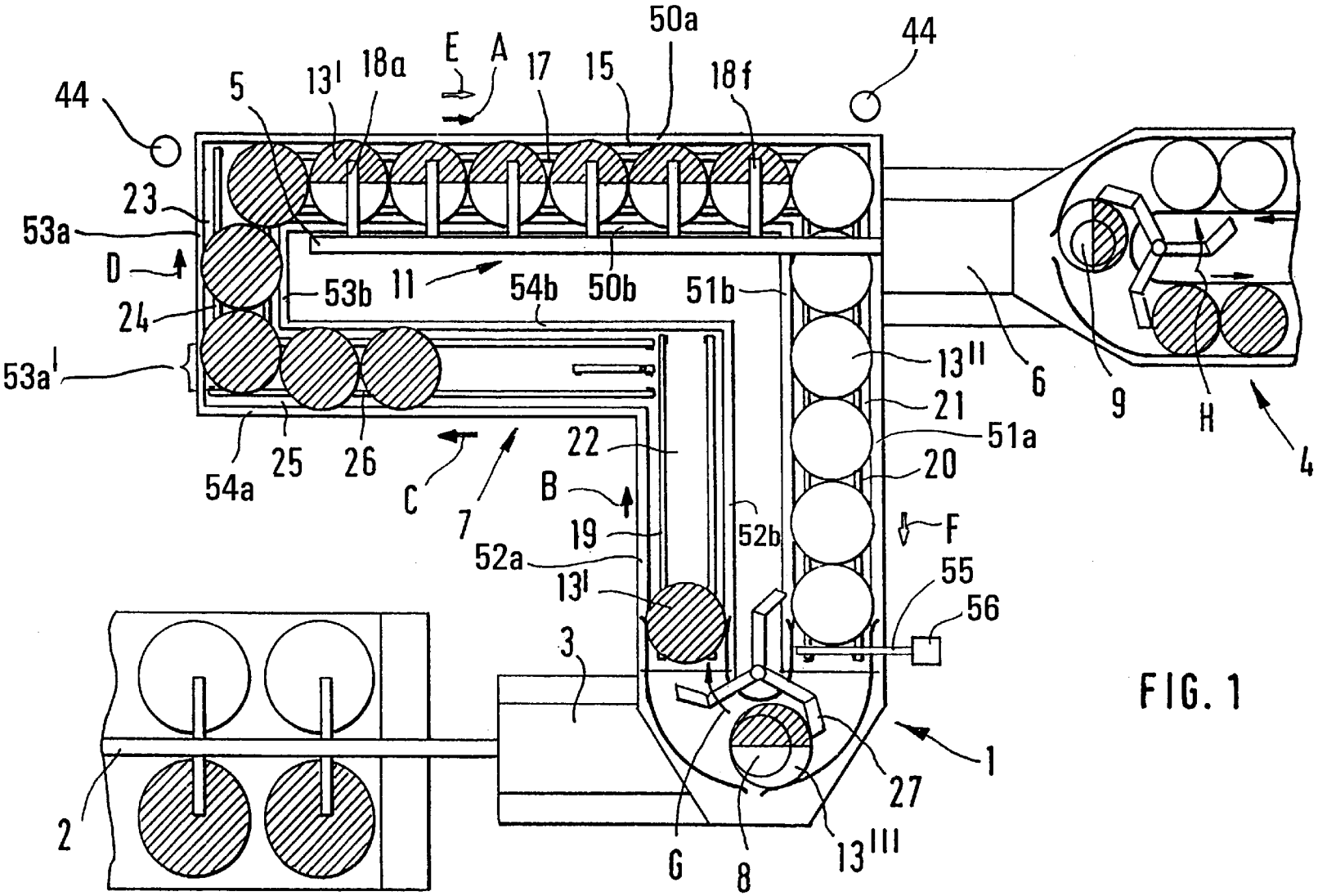
FIG. 1 is a schematic top plan view of a coiler can conveyor system according to the invention.

Turning to FIG. 1, two drawing frames 1 and 4 of a sliver processing line are arranged in series wherein the drawing frame 1 is the upstream machine and the drawing frame 4 is the downstream machine as viewed in the order of consecutive sliver processing. The drawing frame 1 has an intake table 2, a drawing unit 3 and a sliver depositing device 8 (having a rotary coiler head) , whereas the drawing frame 4 has an intake table 5, a drawing unit 6 and a sliver depositing device 9 (having a rotary coiler head). The drawing frame 1 and/or 4 may be an HS model manufactured by Trutzschler GmbH & Co. KG, Mönchengladbach, Germany.

Figure 4:
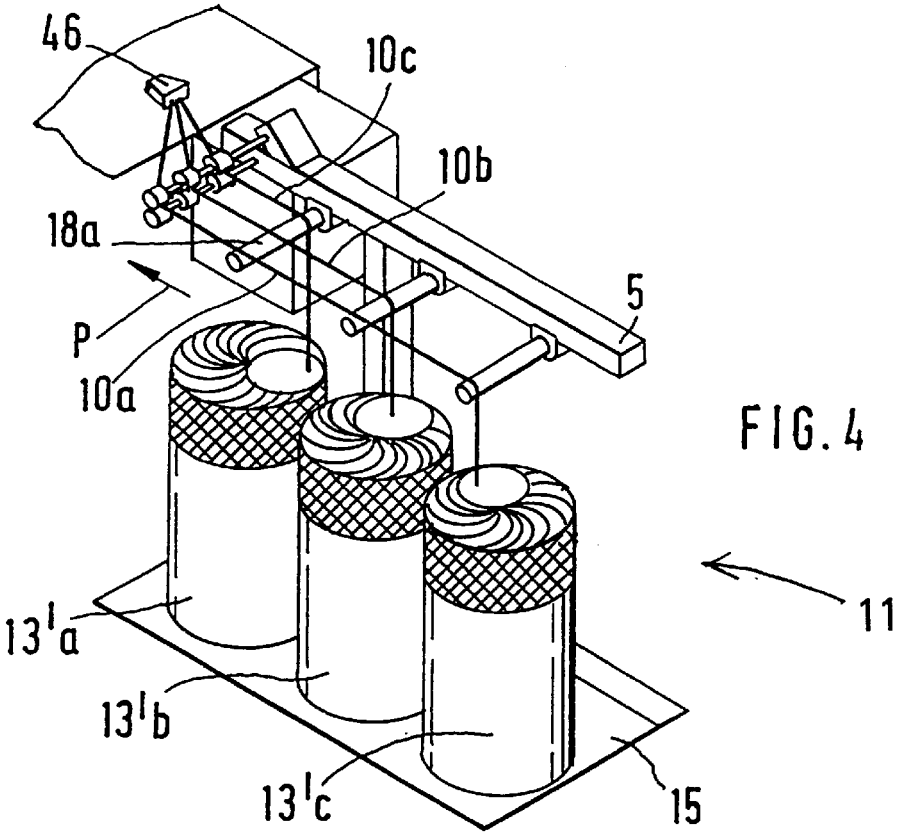
FIG. 4 is a schematic perspective view of an intake table of a drawing frame, showing coiler cans in an operational position.

Also referring to FIG. 4, the drawing unit 6 of the downstream drawing frame 4 is supplied with sliver 10 from coiler cans 13'*a*, 13'*b* and 13'*c* standing in a creel row 11 underneath supply rollers 18*a*–18*f* of an intake table 5. The coiler cans are supported in the creel row 11 on a conveyor track 15. To the sliver delivery device 8 of the upstream drawing frame 1 there extends a conveyor track (supply track) 21 from an outlet end of the creel row 11 for supplying empty cans to the sliver delivery device 8. A conveyor track (removal track) 22 for the sliver-filled cans extends from the sliver delivery device 8. The conveyor track 15 is arranged perpendicularly to the supply track 21 and the removal track 22. A conveyor track 23 and the removal track 22 are connected with one another by means of a further conveyor track 25. The conveyor tracks 15, 21, 22, 23 and 25 have respective conveying devices 17, 20, 19, 24 and 26 for moving the coiler cans along the conveyor tracks.

The coiler can conveyor system 7 thus comprises essentially the conveyor track 15, the supply conveyor track 21, the removal conveyor track 22 and the conveyor tracks 23 and 25 which are all joined end-to-end and form a closed-circuit track assembly arranged in a rectangular pattern such that the conveyor track 15 extends parallel to the conveyor track 25 whereas the conveyor tracks 21, 22 and 23 are parallel to one another. The solid-line arrows A, B, C and D indicate the path of conveyance of the full cans 13' whereas the outlined (empty) arrows E and F indicate the path of conveyance of the empty cans 13". The empty cans 13" are pushed by a rotary coiler can exchanger (turnstile) 27 which rotates in the direction G, from the supply track 21 to underneath the rotary coiler head of the sliver delivery device 8. At that location the cans are then filled with sliver 10 (13'" indicates a partially filled can) and thereafter they are pushed as full cans 13' by the turnstile 27 onto the removal track 22. The coiler cans 13', 13" which circulate in the closed coiler can system are conveyed in a forward direction as indicated by the arrows A–F. The arrangement of the coiler can conveying system shown in FIG. 1 is particularly space saving.

Figure 2:
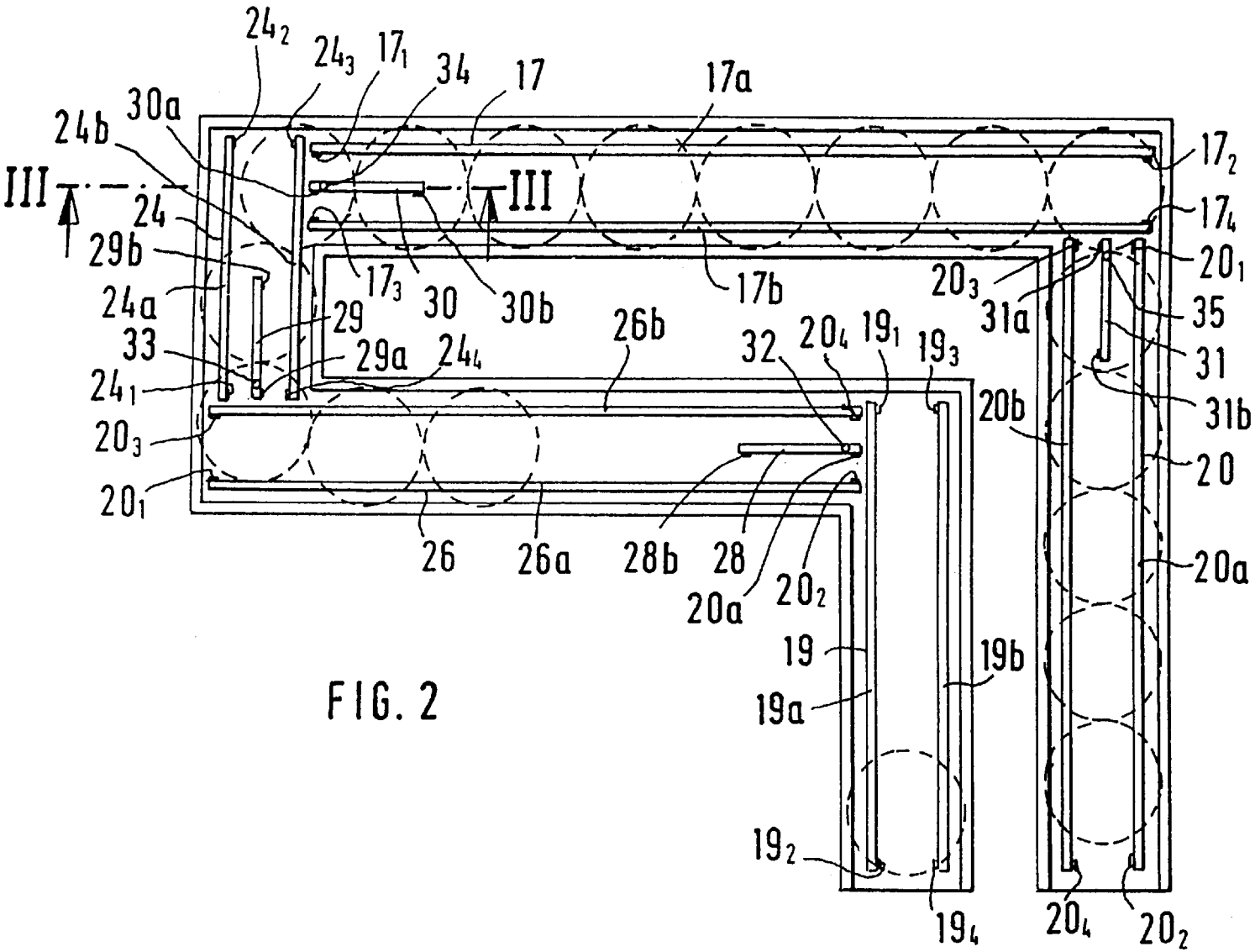
FIG. 2 is an enlarged schematic top plan view of one part of the structure of FIG. 2, showing additional details.

According to FIG. 2, the conveying devices 17, 19, 20, 24 and 26 are arranged close to the floor. Each conveying device has two parallel running conveyor belts 17*a*, 17*b*; 19*a*, 19*b*; 20*a*, 20*b*; 24*a*, 24*b* and 26*a*, 26*b* which circulate about end rollers $\mathbf{17}_1$ to $\mathbf{17}_4$; $\mathbf{19}_1$ to $\mathbf{19}_4$; $\mathbf{20}_1$ to $\mathbf{20}_4$; $\mathbf{24}_1$ to $\mathbf{24}_4$ and $\mathbf{26}_1$ to $\mathbf{26}_4$. The conveying devices may be designed, for example, as described in published German Patent Application 195 09 928.1. The end rollers of the belts of the same belt pair are, at each belt end, arranged coaxially to one another.

Considering FIGS. 1 and 2 together, between two adjoining conveyor tracks 22, 25; 25, 23; 23, 15; and 15, 21 a respective, short circulating endless transfer belt 28, 29, 30 and 31 is provided to function as a can transfer device. In each instance the can transfer device is arranged on the receiving conveyor track of the two adjoining conveyor tracks. Thus, the transfer belt 28 is arranged on the conveyor track 25 to receive cans from the conveyor track 22; the transfer belt 29 is arranged on the conveyor track 23 to receive cans from the conveyor track 25; the transfer belt 30 is arranged on the conveyor track 15 to receive cans from the conveyor track 23; and the transfer belt 31 is arranged on the conveyor track 21 to receive cans from the conveyor track 15. The transfer belts 28, 29, 30 and 31 which circulate about end rollers 28*a*, 28*b*; 29*a*, 29*b*; 30*a*, 30*b*; and 31*a*, 31*b* are arranged parallel to the conveyor belts 26*a*, 26*b*; 24*a*, 24*b*; 17*a*, 17*b*; and 20*a*, 20*b*, respectively. In each instance, the end roller at the inlet end of the transfer belt is in alignment with the end rollers at the inlet ends of the respective conveyor belts. Expediently, the outer surface of the upper run of the transfer belts 28, 29, 30 and 31 is at a slightly lower height level than that of the outer faces of the upper runs of the respective conveyor belts 26*a*, 26*b*; 24*a*, 24*b*; 17*a*, 17*b*; and 20*a*, 20*b*, and further, the effective length of each transfer belt 28, 29, 30 and 31 approximately corresponds to the diameter of the coiler cans. At the outer face of each transfer belt 28, 29, 30 and 31 a respective carrier element such as a pin 32, 33, 34 and 35 is arranged which, when situated on the upper run of the associated transfer belt, projects upwardly beyond the height level of the transporting surface of the respective conveyor from which transfer by the transfer belt is effected. The arrows A through F indicate the direction of motion of the upper belt run of the conveyor belts and the transfer belts associated with the respective conveyor belts.

As shown in FIG. 3*a*, a can 13' is situated on the conveyor belts 24*a*, 24*b* at the end of the conveyor track 23. The coiler can has a bottom 36' from which extends a peripheral, downwardly oriented terminal rim 36" which, together with the underface of the can bottom 36', defines a depression 36. The can 13' projects laterally outwardly beyond the conveyor belts 24*a*, 24*b* and thus the end roller 30*a* of the transfer belt 30 is situated underneath that region of the coiler can 13' which projects laterally beyond the conveyor belt 24*b*. When the coiler can 13' is in its position shown in FIG. 3*a*, on a command signal an electric motor 37 sets the transfer belt 30 in motion such that its upper and the lower runs move in the direction of the arrows I and K, respectively. As a result of this operation, the coiler can carrier 34 moves on the end roller 30*a* from below upwardly and projects into the depression 36 of the coiler can. As the transfer belt 30 continues to move, the can carrier 34 engages the inside face of the can rim 36" and pulls the coiler can 13' in the direction N from the conveyor belts 24*a*, 24*b* of the conveyor track 23 onto the conveyor belts 17*a*, 17*b* of the conveyor track 15. As the carrier 34 reaches the end of the upper run of the transfer belt 30, it travels downwardly out of its operational range about the end roller 30*b* and then travels in the reverse direction on the lower run of the transfer belt 30 as shown in FIG. 3*b*. At the same time, the conveyor belts 17*a*, 17*b* of the conveyor track 15, circulated by the drive motor 38 move the coiler can 13' forwardly in the direction O (designated at A and E in FIG. 1). The transfer belts 28, 29 and 31 operate identically to the transfer belt 30 to shift coiler cans onto the respective conveyor tracks 25, 23 and 21.

As shown in FIGS. 1 and 4, and as described earlier, the conveyor track 15 forms part of the creel row 11 where the coiler cans are positioned for feeding the drawing unit 6 of the drawing frame 4 in the direction P, through a sliver guide (sliver intake trumpet) 46.

Figure 5:
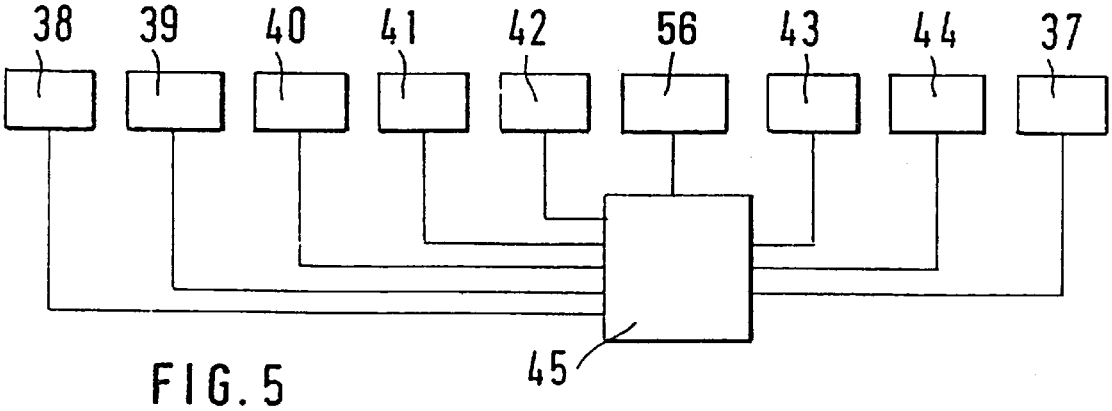
FIG. 5 is a block diagram illustrating the control of the various drives and components for the conveyor system according to the invention.

In FIG. 5 an electronic control and regulating device 45 such as a microcomputer is shown to which there are connected the driving devices 38–42, for example, drive motors for the serially arranged conveying devices 19, 26, 24, 17 and 20, the drive motor 43 for the turnstile 27, sensors 44 for the path control of the coiler cans 13', 13" and drive motors (such as drive motor 37) for the transfer devices 28, 29, 30, 31. The sensors 44 may be located, for example, such that they emit a signal when a coiler can reaches the outlet end of a conveying device. Such sensors 44 are shown, for example, at the outlet end of the conveyor track 23 and at the outlet end of the conveyor track 15. Such signal may be utilized for initiating the motion of the respective transfer belt 28, 29, 30 or 31. The can conveying system 7 thus permits an automatic can conveyance and can replacement during operation between the drawing frames 1 and 4.

By virtue of the independently driven conveying devices of the various conveyor tracks as well as the transfer devices, the electronic control and regulating device 45, by means of a suitable energization and deenergization of the drives, makes possible an accumulation of the coiler cans on all or selected ones of conveyor tracks. In such an accumulated state the coiler cans are situated single file, in a mutually contacting position, as shown for the conveyor tracks 15, 21, 23 and 25 in FIG. 1. To achieve such an accumulated, mutually contacting state of the coiler cans, it is necessary to prevent motion of a selected can on the conveyor track to thus allow the conveying device to bring up consecutive cans behind the arrested can. In this manner the conveying device (that is, the conveyor belts on which the coiler cans stand) will slide underneath the stopped cans and will bring consecutively additional cans to be stopped by the coiler can immediately ahead. In the embodiment shown in FIG. 1, the conveyor tracks which join each other perpendicularly, include a lateral guide rail on each side. Thus, the conveyor track 15 has lateral guide rails 50*a*, 50*b*; the conveyor track 21 has lateral side rails 51*a*, 51*b*; the conveyor track 22 has lateral side rails 52*a*, 52*b*; the conveyor track 23 has lateral side rails 53*a*, 53*b*; and the conveyor track 25 has lateral side rails 54*a*, 54*b*.

The lateral guide rails provide, at the outlet end of the conveyor tracks 15, 22, 23 and 24 a stop or abutment so that in case the transfer device at the inlet of the adjoining conveyor track is idle, the coiler can at the outlet of the preceding conveyor track will be immobilized, thus allowing the cans to accumulate therebehind. For example, the side rail zone 53*a*' of the side rail 53*a* will abut and stop any coiler can arriving at the outlet end of the conveyor track 25, provided that the transfer device 29 of the conveyor track 23 is idle. Similar side rail zones serve as stops for the coiler cans arriving at the outlet end of the conveyor tracks 15, 22 and 23.

For abutting and stopping a coiler can at the outlet end of the conveyor track 21, that is, within the operating range of the turnstile 27, expediently a gate 55 is provided, having a control unit 56, connected to the electronic control and regulating device 45 as shown in FIG. 5. The gate 55 may be in a lowered, operative position in which it acts as a stop for the leading coiler can on the conveyor track 21 whereas in its raised, inoperative position it will allow the turnstile 27 to move the coiler can away from the conveyor track 21. It is noted that such a coiler can arresting and releasing arrangement is disclosed in U.S. patent application Ser. No. 08/617,328 filed Mar. 28, 1996 which is hereby incorporated by reference. It will be understood that the gating device 55, 56, may be arranged at any desired location of a selected conveyor track.

It will be understood that the above description of the present invention is susceptible to various modifications, changes and adaptations, and the same are intended to be comprehended within the meaning and range of equivalents of the appended claims.

What is claimed is:

1. A system comprising (a) a first drawing frame having a sliver output where sliver from the first drawing frame is deposited in coiler cans;

(b) a second drawing frame having a sliver input where sliver is supplied to said second drawing frame from sliver-filled coiler cans; and (c) a conveyor apparatus for supplying, in a closed circuit, sliver-filled coiler cans from the output of said first drawing frame to the input of said second drawing frame and for supplying empty coiler cans from the input of said second drawing frame to the output of said first drawing frame; said conveyor apparatus including (1) a first storage device for supporting a plurality of sliver-filled coiler cans; said first storage device being formed of a first conveyor track extending between said output of said first drawing frame and said input of said second drawing frame; said first conveyor track having an input end and an output end;

(2) a second storage device for supporting a plurality of empty coiler cans; said second storage device being formed of a second conveyor track extending between said input of said second drawing frame and said output of said first drawing frame; said second conveyor track having an input end and an output end; said output end of said second conveyor track joining said input end of said first conveyor track and said output end of said first conveyor track joining said input end of said second conveyor track; said first and second conveyor tracks being mutually non-intersecting and non-overlapping;

(3) conveying means for solely unidirectionally advancing the sliver-filled coiler cans and the empty coiler cans in a continuous, non-intersecting and non-overlapping endless path; said conveying means including (i) a first conveying device for moving the sliver-filled coiler cans on and along said first conveyor track; and (ii) a second conveying device for moving the empty coiler cans on and along said second conveyor track.

2. The system as defined in claim 1, wherein at least one of said first and second conveyor tracks is formed of end-to-end arranged partial conveyor tracks oriented at an inclination to one another, whereby said closed circuit is of polygonal configuration.

3. The system as defined in claim 1, wherein at least one of said conveying devices comprises an endless conveyor belt.

4. The system as defined in claim 1, further comprising accumulating means for gathering the coiler cans into an accumulated state in which the coiler cans stand on one of said conveyor tracks in a mutually contacting series along said one conveyor track.

5. The system as defined in claim 4, wherein said accumulating means comprises an abutment device for stopping an advance of a leading coiler can on said one conveyor track by the conveying device thereof thereby causing trailing coiler cans to accumulate therebehind in a mutually contacting relationship.

6. The system as defined in claim 5, wherein said abutment device comprises a movable gate having a first position for causing an advancing coiler can to collide therewith and being stopped thereby and a second position for allowing coiler cans to pass; further comprising control means for selectively placing said movable gate into said first or second position.

7. The system as defined in claim 6, wherein said control means comprises an electronic control and regulating device.

8. The system as defined in claim 5, further comprising control means for controlling said transferring means to selectively leave a leading coiler can on one of the conveyor tracks or transfer the leading coiler can to an adjoining conveyor track.

9. The system as defined in claim 8, further comprising sensor means for generating a signal when a coiler can reaches a predetermined position on one of said first and second conveyor tracks; said sensor means being connected to said control means.

10. The system as defined in claim 1, further comprising first transferring means for moving sliver-filled coiler cans from said output end of said second conveyor track to said input end of said first conveyor track and second transferring means for moving empty coiler cans from said output end of said first conveyor track to said input end of said second conveyor track; said first and second transferring means being composed of components separate from said conveying means.

* * * * *